US005870879A

United States Patent [19]

Wang

[11] Patent Number: 5,870,879

[45] Date of Patent: Feb. 16, 1999

[54] FILM SLEEVER MACHINE

[76] Inventor: Xiao Chun Wang, 2810 Eaglecrest Pl., Diamond Bar, Calif. 91765

[21] Appl. No.: 767,210

[22] Filed: Dec. 16, 1996

[51] Int. Cl.[6] ..... B65B 5/00; B65B 43/26; B65B 61/06; B65B 63/00

[52] U.S. Cl. ..... 53/55; 53/284.2; 53/389.3; 53/389.4; 53/520; 53/570

[58] Field of Search ..... 53/493, 505, 520, 53/459, 55, 570, 64, 284.2, 384.1, 389.2, 389.4, 568

[56] References Cited

U.S. PATENT DOCUMENTS

| | | | |
|---|---|---|---|
| 2,892,295 | 6/1959 | McArthur | 53/520 |
| 2,937,483 | 5/1960 | Engelstein | 53/520 |
| 3,457,697 | 7/1969 | Engelstein | 53/520 |
| 3,872,645 | 3/1975 | Dorman | 53/284.2 X |
| 3,896,603 | 7/1975 | Tout | 53/284.2 X |
| 4,003,187 | 1/1977 | Kiejzik | 53/520 |
| 4,064,677 | 12/1977 | Takahashi et al. | 53/520 |
| 4,099,362 | 7/1978 | Dorman | 53/520 |
| 4,231,214 | 11/1980 | Kiejzik | 53/520 |
| 4,258,531 | 3/1981 | Kiejzik | 53/520 |
| 4,616,473 | 10/1986 | Hodges et al. | 53/520 |
| 4,787,766 | 11/1988 | Lorsch | 53/284.2 X |
| 4,974,394 | 12/1990 | Suzuki | 53/520 X |
| 4,995,219 | 2/1991 | Hicks | 53/570 X |
| 5,070,677 | 12/1991 | Hicks | 53/570 X |
| 5,533,322 | 7/1996 | Bacon et al. | 53/551 X |

*Primary Examiner*—Horace M. Culver
*Attorney, Agent, or Firm*—David & Raymond; Raymond Y. Chan

[57] ABSTRACT

A film sleever machine includes a first stepper motor for activating a sleeve delivery device which has a driving shaft and a roller shaft mounted parallelly for feeding a film wearing bag material. A film feeding device which has a film driving wheel and a pressure wheel is activated by a second stepper motor for feeding a roll of film to insert into a plurality of film wearing sleeve of the film wearing bag material. The first stepper motor also activates a film cutter device to cut off the film. The second stepper motor also activates a sleeve cutter device to cut off the film wearing bag material. Accordingly, the film sleever machine can be operated to feed the film, cut the film, feed the sleeves, and cut off the sleeves automatically.

30 Claims, 13 Drawing Sheets

FILM SLEEVER MACHINE

BACKGROUND OF THE PRESENT INVENTION

The present invention relates to film sleeving, and more particularly to a multi-functional film sleever machine which can cut a roll of film to a plurality of film strips with predetermined length and pack the film with film wearing bags automatically. The film sleever machine is easy to operate and can pack the film rapidly and accurately without damaging the film and staining the film with fingerprints.

After developing a roll of film, the roll of film generally is cut to a plurality of film strips with predetermined length for packing with a film wearing bag for protection. As shown in FIG. 1, the film wearing bag 10 has an opened side 11 and is divided into several film chamber units 12, so that the film strips can be inserted into the film chamber units 12 through the opened side 11 respectively so as to avoid any staining or damaging of the film.

A conventional semi-automatic film packing tool 20, as shown in FIG. 2, is used to save the labor for packing the film. A roll of film wearing bag material 100 is pivotally mounted on the film packing tool 20 by a sleeving mounting spool assembly 21. The conventional film packing tool 20 merely provides a motor to drive a film driving roller (not shown in Figure) to rotate for driving the film wearing bag material 100 to deliver between the film driving roller and a pair of pressure rollers 22. However, the operator of the conventional film packing tool 20 still has to feed the roll of film by hand to insert into the respective film chamber unit 12 of the film wearing bag material 100 and cut the film by means of a film cutter 23 manually. Moreover, after the roll of film is cut into the plurality of film strips to insert into the respective film chamber units 12, the operator has to operate a rotary sleeving cutter 24 to cut off the portion of film wearing bag material 100 which is worn with the film strips manually. Accordingly, the conventional film packing tool 20, in fact, is only an automatic film wearing bag delivery tool and the operator still has to busy in operating the feeding of film, the cutting of film and the cutting of film wearing bag.

Besides, the conventional film packing tool 20 still has plenty of unsolved drawbacks as follows:

(1) The conventional film packing tool 20 does not provide any supporting frame to mount the parts such as the driving shaft of the film wearing bag driving roller, therefore constructional error may easily occurred that will affect the concentricity of the driving shaft and cause operating noise.

(2) The feeding of the roll of film is assisted and guided by a pressure wheel 25. However, the pressure wheel is longitudinally rolling on the film surface that may leave unrecoverable tracks thereon.

(3) Since the conventional film packing tool 20 requires the operator to cut the film manually, the operator has to carefully aim the film cutter 23 at the interval between two film units. It is time consuming and will decrease the efficiency. In fact, the operator's eyes will feel tiredness after a certain operating time. Sometimes, the operator may mistakenly cut on the film unit.

(4) The conventional film packing tool 20 is designed for film having a width of 35 mm. For No. 110 film, its width is 16 mm, so that when the No. 110 film is fed to the conventional film packing tool 20, the No. 110 film can not be well guided and may swing left and right. It may render the feeding of the No. 110 film difficult.

(5) The conventional film packing tool 20 requires the operator to remove the residual film tail manually.

(6) The delivering of the film wearing bag material 100 of the conventional film packing tool 20 is controlled by a photo sensor blocking device 26. In order to equip with the photo sensor blocking device 26, as shown in FIG. 1, the film wearing bag material 100 must be printed with a plurality of blocking color signs 13 on the intervals between each two film chamber units 12 respectively, so that when the photo sensor blocking device 26 detects each blocking color sign 13, the driving roller will stop. Of course, it is a way to control the feeding stroke of the film wearing bag material 100, but all the film wearing bag material 100 must be made to have such blocking color signs printed thereon, that may increase the manufacturing steps and cost of the film wearing bag material 100. Since the blocking color signs must be accurately printed on the intervals between those film chamber units 12 with a predetermined darkness, generally about 23% to 28% of the film wearing bag material 100 will be printed with lightened color or misprinted on the film chamber units 12.

SUMMARY OF THE PRESENT INVENTION

It is an object of the present invention to provide a film sleever machine which can cut a roll of film to a plurality of film strips with predetermined length and pack the film with film wearing bags automatically.

It is still another object of the present invention to provide a film sleever machine which is adapted to automatically guide the feeding of the film, deliver the roll of film wearing bags, insert the film into the respective film wearing bag, cut the film, cut the film wearing bags, and remove the residual film tail.

It is still another object of the present invention to provide a film sleever machine which is easy to operate and can pack the film rapidly and accurately without damaging the film and staining the film with fingerprints.

It is yet another object of the present invention to provide a film sleeve machine in which the driving shaft of the film wearing bag driving roller is rotatably mounted on a supporting frame so as to ensure the concentricity of the driving shaft and reduce the operating noise.

It is yet another object of the present invention to provide a film sleever machine wherein the feeding of the roll of film is assisted and guided by a pressure wheel which is adapted to roll along the longitudinal side edge of the film, so that no track will be left on the film surface.

It is yet another object of the present invention to provide a film sleever machine wherein the feeding of the film is guided by a film guilder which is adjustable to adapted for guiding the feeding of both the 16 mm No. 110 film and the 35 mm film.

It is yet another object of the present invention to provide a film sleever machine in which the feeding stoke of the delivery of the film wearing bag material is self-controlled by two stepper motors which are the power source of the present invention. In other words, no conventional photo sensor blocking device is used, so that the film wearing bag material does not required to be printed with blocking color signs thereon. It greatly reduces the manufacturing cost of the film wearing bag material.

Accordingly, in order to accomplish the above objects, the present invention provides a film sleever machine comprising a housing having a top wearing platform and a front delivery opening provided thereon;

a front and a rear supporting frame affixed in the housing;

a sleeving mounting spool assembly having a mounting spool pivotally mounted on the housing for rotatably supporting a roll of film wearing bag material which has a predetermined number of film wearing sleeves transversely and continuously connected with each other;

a wearing bag delivery device which comprises a driving shaft pivotally mounted transversely on the rear supporting frame and a rolling shaft rotatably mounted in parallel and above the driving shaft;

a first stepper motor mounted on the rear supporting frame for driving the driving shaft to rotate for a predetermined number of revolution, so that the rotating driving shaft drives the film wearing bag material to longitudinally feed between the driving shaft and the rolling shaft and deliver to the wearing platform of the housing, wherein the first stepper motor is controlled by a controlling system to drive the driving shaft to feed forward one film wearing sleeve per each forward activation of the first stepper motor;

a sleeving guide installed on a side of the wearing platform for spreading an opened side of the film wearing bag material;

a film delivery guiding assembly installed on the housing for guiding a roll of film, which has a predetermined number of continuous film units, to be delivered to the wearing platform of the housing;

a film feeding device which comprises a film driving wheel pivotally mounted on a lateral side of the front supporting frame and a pressure wheel rotatably mounted on the film delivery guiding assembly and above the film driving wheel, wherein the pressure wheel is propped against the film driving wheel;

a second stepper motor mounted on the front supporting frame for driving the film driving wheel to rotate for a predetermined number of revolution, so that, per each forward activation of the second stepper motor, the rotating film driving wheel drives a predetermined number of film units to feed between the film driving wheel and the pressure wheel and insert into a corresponding film wearing sleeve of the film wearing bag material, which is delivered from the sleeving mounting spool assembly to locate on the wearing platform, through the spread opened side thereof, wherein the second stepper motor is also controlled by the controlling system to drive the film driving wheel to feed forward a predetermined number of film units per each forward activation of the second stepper motor;

a film cutter device mounted on the housing for cutting off the film units which are worn within the corresponding film wearing sleeve on the wearing platform from the roll of film; and a sleeve cutter device mounted transversely on the front supporting frame in the housing for cutting off a predetermined number of film wearing sleeves which worn with film units therein front the roll of film wearing bag material.

DETAILED DESCRIPTION OF THE PREFERRED EMBODIMENT

Figure 1:
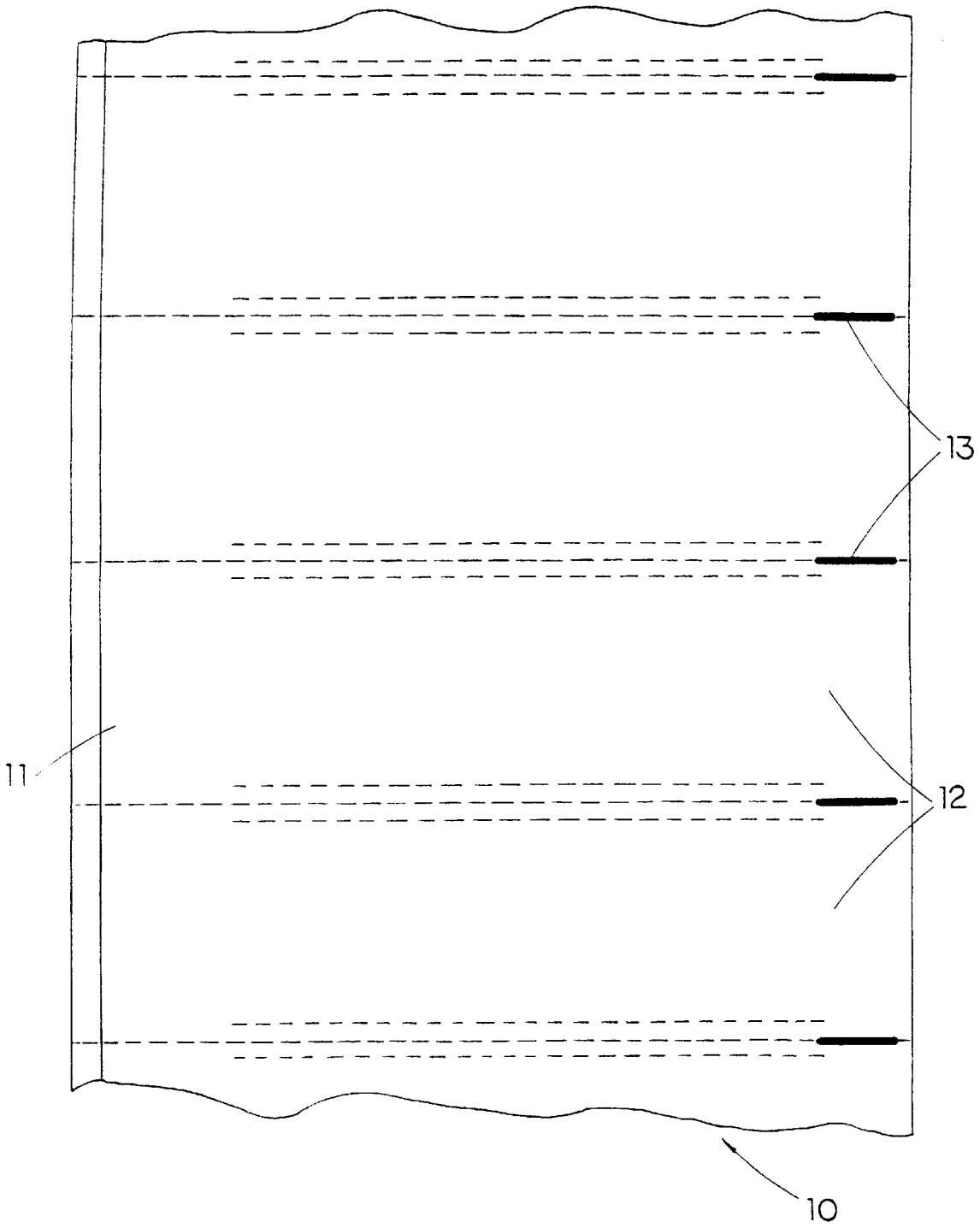
FIG. 1 is a plan view of a conventional film wearing bag material having blocking color sign printed thereon.
Figure 2:
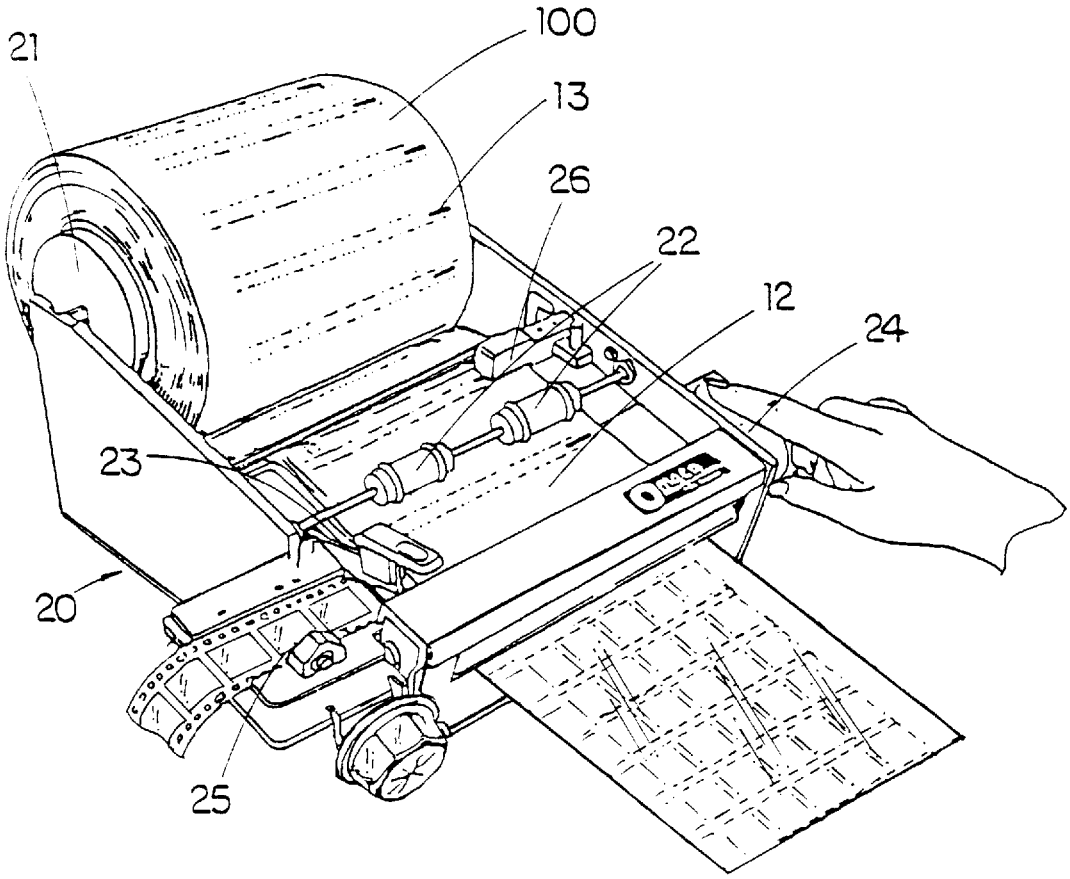
FIG. 2 is a perspective view of a conventional semi-automatic film packing tool.
Figure 3:
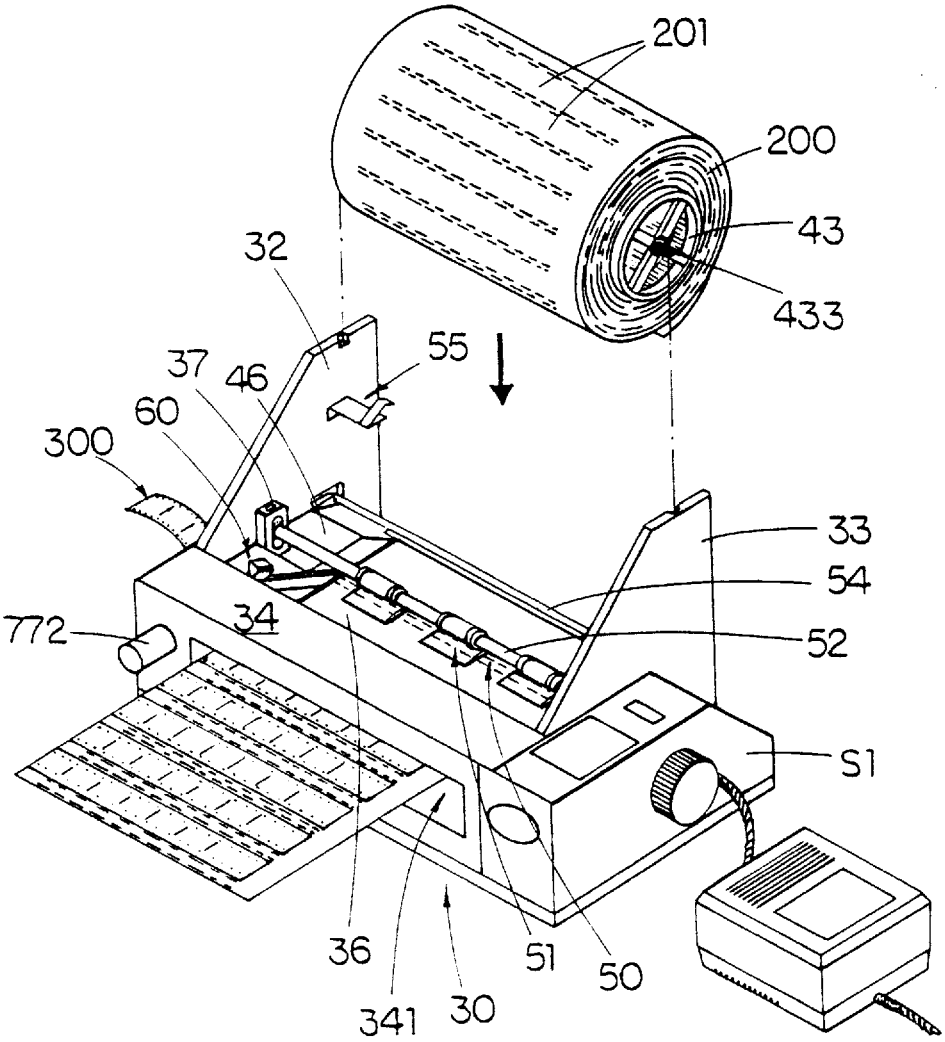
FIG. 3 is a perspective view of a film sleeve machine according to a preferred embodiment of the present invention.
Figure 4:
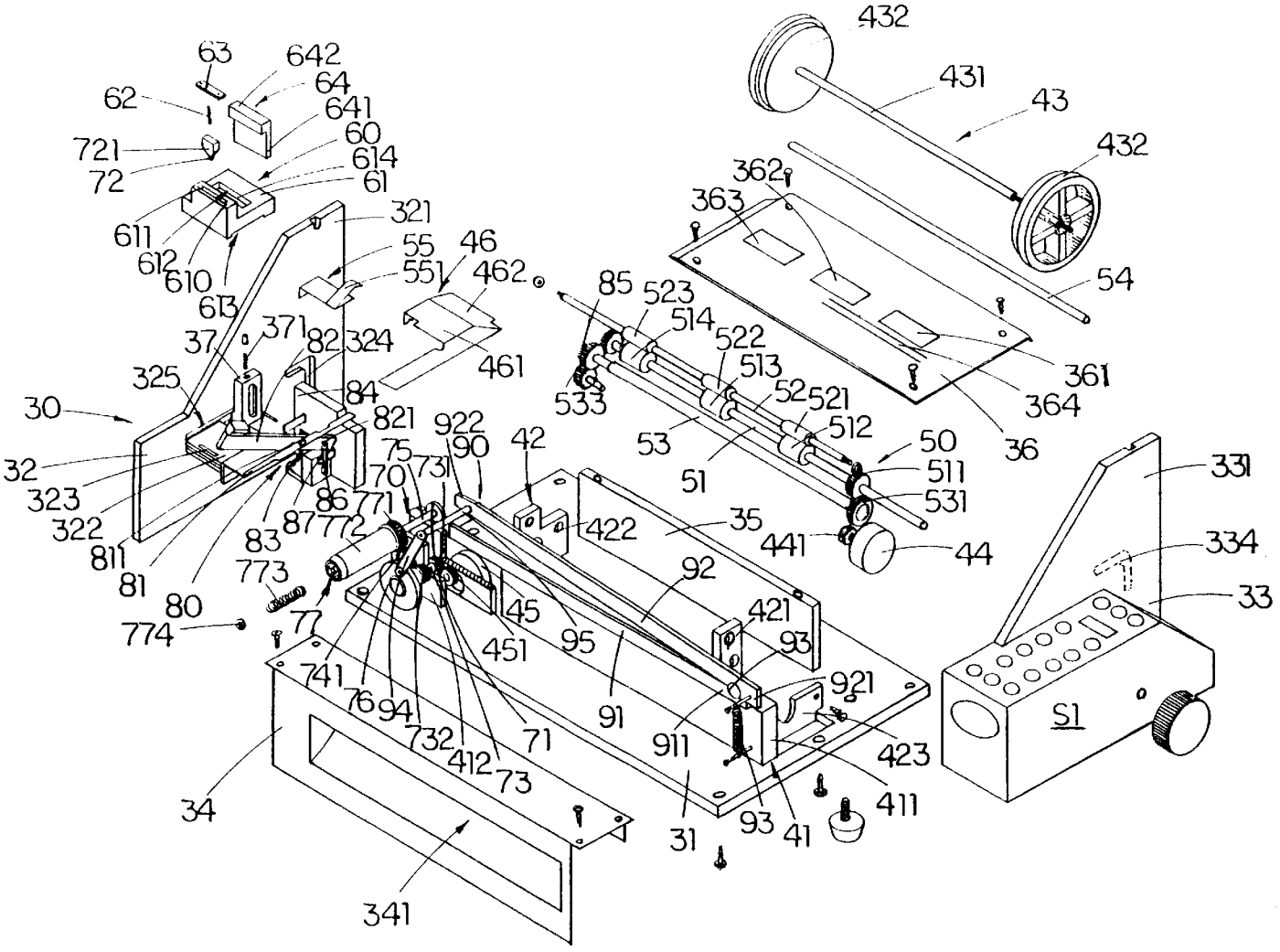
FIG. 4 is an exploded perspective view of the above preferred embodiment of the present invention.

Referring to FIGS. 3 to 13, a film sleever machine according to the present invention is illustrated. The film sleever machine, as shown in FIGS. 3 and 4, comprises a housing 30, a front supporting frame 41, a rear supporting frame 42, a sleeving mounting spool assembly 43, a first stepper motor 44, a second stepper motor 45, a sleeving guide 46, a wearing bag delivery device 50, a film delivery guiding assembly 60, a film feeding device 70, a film cutter device 80, and a sleeve cutter device 90.

Referring to FIGS. 3 and 4, the housing 30 comprises a bottom board 31, two side walls 32, 33 perpendicularly affixed on a right side and a left side of the bottom board 31 respectively, a front cover 34 which is detachably mounted on the two side walls 32, 33 and has a front delivery opening 341 formed at a front side thereof, a rear wall 35 affixed on a rear side of the bottom board 31, and a wearing platform 36 adapted to cover the housing 30 by screwing onto the rear wall 35 and the front supporting frame 41.

The front and a rear supporting frame 41, 42 are affixed in the housing 30, in which the front supporting frame 41, which has a first end 411 and a second end 412, is a rectangular frame board transversely secured on a front side of the bottom board 31. The rear supporting frame 42 comprises two shaft supports 421, 422 affixed parallelly between the rear board 35 and the front supporting frame 41. The rear supporting frame 42 further comprises a motor stand 423 affixed near the right side of the bottom board 31 for rigidly mounting the first stepper motor 44 thereon.

Figure 14:
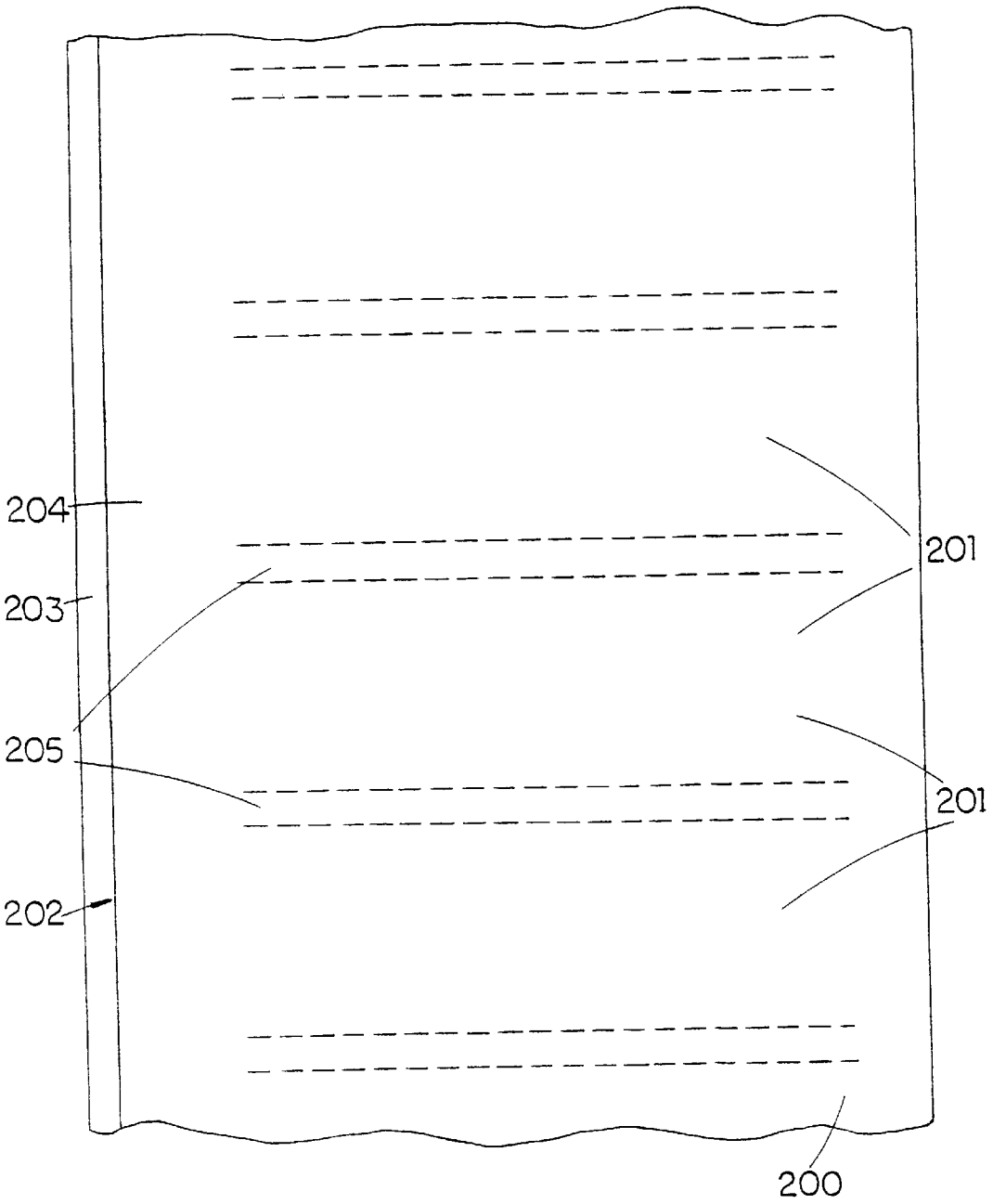
FIG. 14 is a plan view of the film wearing bag material for the present invention.

The sleeving mounting spool assembly 43 comprises a mounting spool 431 and two spool wheels 432 detachably affixed to two end portions of the mounting spool 431. The sleeving mounting spool assembly 43 is pivotally mounted on the housing 30 by pivotally sitting two end axles 433 of the mounting spool 431 between two upwardly extending side supporters 321, 331 of the two side walls 32, 33 respectively, for rotatably supporting a roll of film wearing bag material 200 which has a predetermined number of film wearing sleeves 201 transversely and continuously connected with each other (as shown in FIGS. 3 and 14).

Figure 5:
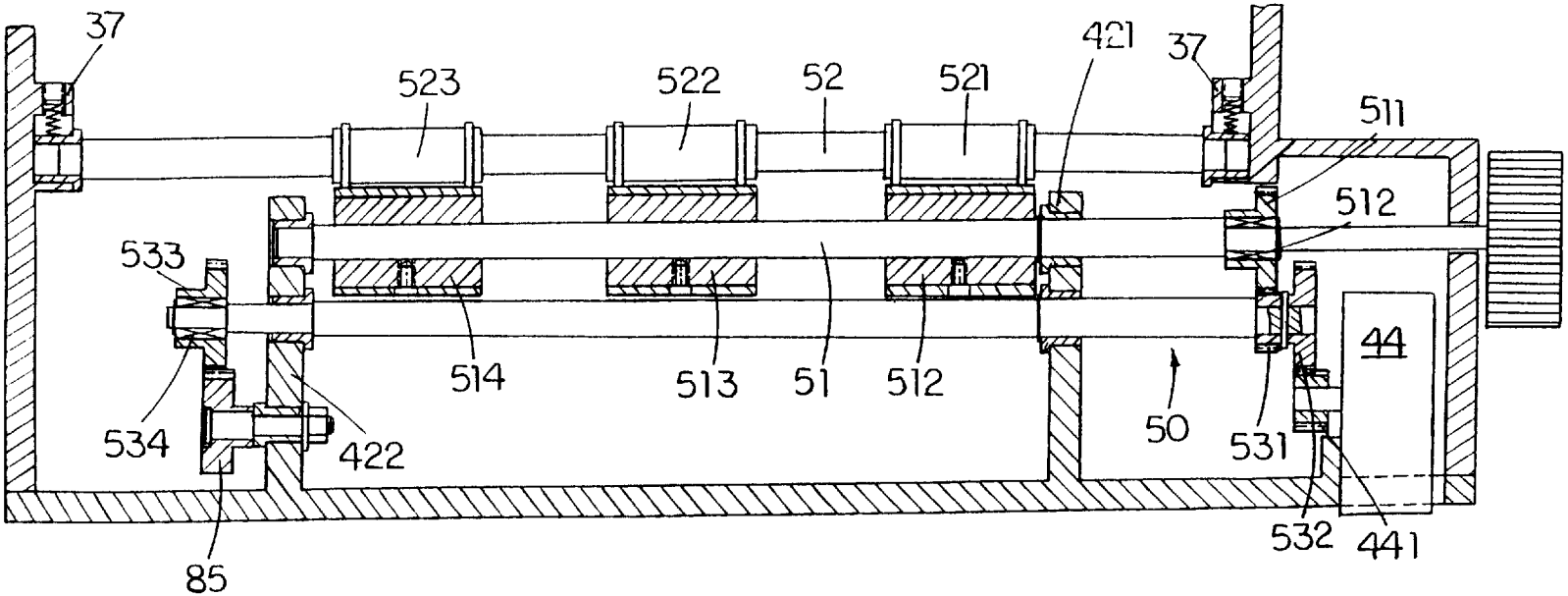
FIG. 5 is a partial section view of a wearing bag delivery device of the above preferred embodiment of the present invention.
Figure 6:
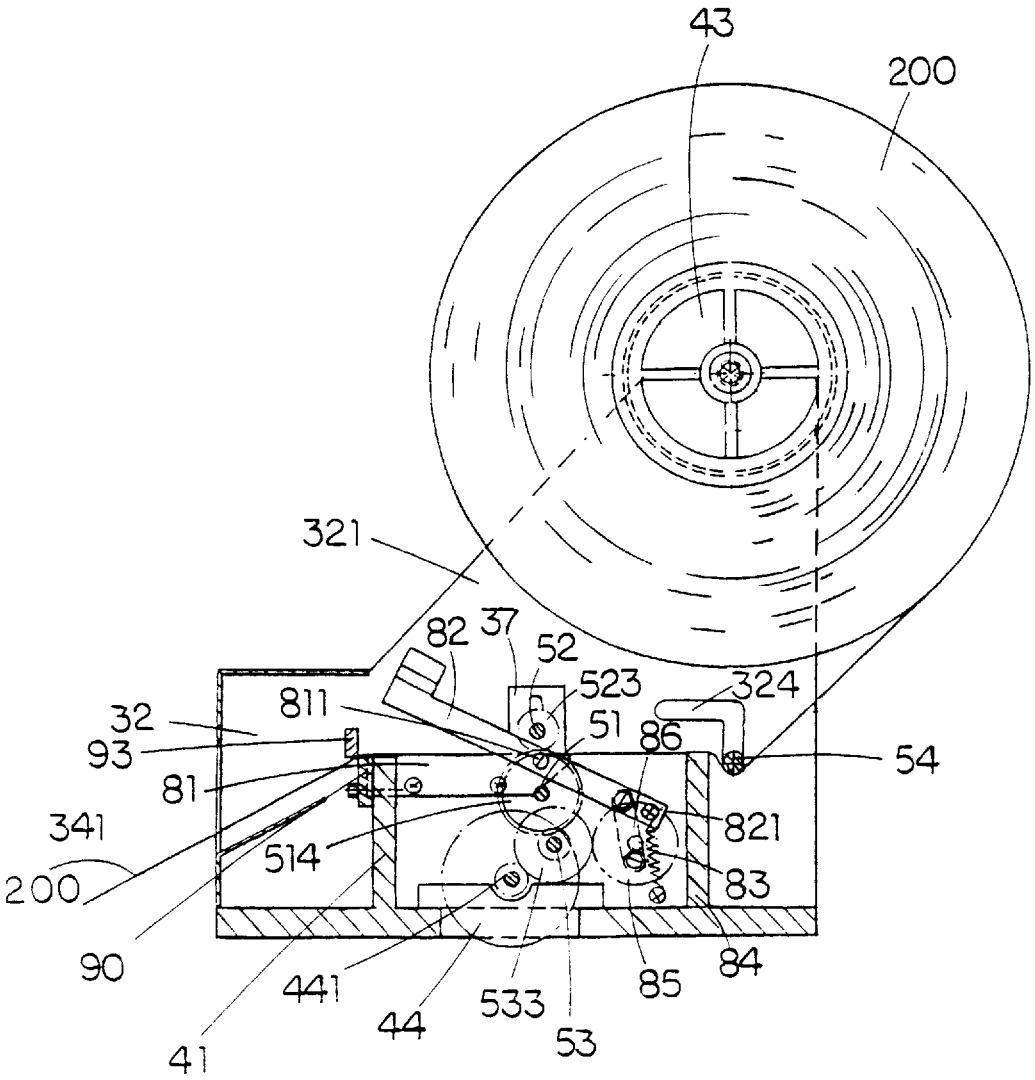
FIG. 6 is a partial end view of the above preferred embodiment, illustrating the constructive relationship between the wearing bag delivery device and a film cutter device.

As shown in FIGS. 4, 5, and 6, the wearing bag delivery device 50 comprises a driving shaft 51 pivotally mounted transversely on the rear supporting frame 42 and a rolling shaft 52 rotatably mounted in parallel and above the driving shaft 51.

As shown in FIGS. 4, 5, and 6, in accordance with the preferred embodiment, the driving shaft 51 is pivoted between the two shaft supports 421, 422 and has a first end extending through the first shaft support 421 to integrally and concentrically connect with a driven gear 511 which has a first one-way clutch means 512 (as shown in FIG. 4) installed therein to idle the driven gear 511 in reverse rotation. Therefore, by means of the first one-way clutch means 512, when the driven gear 511 is driven to rotate forwardly, the driven gear 511 drives the driving shaft 51 to rotate forward simultaneously. However, when the driven gear 511 is driven to rotate rearwardly, the driven gear 511 will rotate idly and the driving shaft 51 will remain stationary.

Three rubber rollers 512, 513, 514 are concentrically and spacedly mounted on the driving shaft 51 for facilitating the delivery of the plastic film wearing bag material 200, wherein the rubber roller 512 is positioned adjacent to the first shaft support 421, the rubber roller 513 is positioned in a central position of the driving shaft 51 between the two shaft supports 421, 422, and the rubber roller 514 is positioned adjacent to the second shaft support 422.

The wearing bag delivery device 50 further comprises a transmission shaft 53, as shown in FIGS. 4 to 6, which is positioned below the driving shaft 51 and is pivotally mounted between the two shaft supports 421, 422 of the rear supporting frame 42. The transmission shaft 53 has a first end and a second end extending through the first shaft support 421 and the second shaft support 422 respectively, wherein the first end of the transmission shaft 53 is concentrically connected with a first transmission gear 531 and a driving gear 532. The first transmission gear 531 is engaged with the driven gear 511 of the driving shaft 51 and the driving gear 532 is engaged with an output gear 441 of the first stepper motor 44. The second end of the transmission shaft 53 is concentrically connected with a second transmission gear 533 which has a second one-way clutch means 534 (as shown in FIG. 4) installed therein to idle the second transmission gear 533 in reverse rotation. Therefore, by means of the second one-way clutch means 534, when the transmission shaft 53 is driven to rotate forwardly, the transmission gear 533 is driven by the transmission shaft 53 to rotate forward simultaneously. However, when the transmission shaft 53 is driven to rotate rearwardly, the transmission shaft 53 will rotate idly and the second transmission gear 533 will remain stationary.

An inner side of each side wall 32, 33 provides a pivot seat 37 for rotatably mounting the rolling shaft 52 between the two side walls 32, 33 and parallelly positioning just above the driving shaft 51. Three O-ring spacers 521, 522, 523 are concentrically mounted on the rolling shaft 52 and aligned with the three rubber rollers 512, 513, 514. Each pivot seat 37 has a spring means 371 adapted for pressing the rolling shaft 52 downwards so as to prop the three O-ring spacers 521, 522, 532 against the three rubber rollers 512, 513, 514. Also, during the initial setting of the film sleever machine of the present invention, the user may temporary push the rolling shaft 52 upward and compress the two spring means 371 of the two pivot seats 37 to enable the film wearing bag material 200 to pass through the gap between driving shaft 51 and the rolling shaft 52 (as shown in FIG. 6).

The inner side of each side wall 32, 33 further has a L-shape groove 324, 334 provided thereon, as shown in FIGS. 4 and 6, for rotatably mounting a dancer rod 54 therebetween. Therefore, the film wearing bag material 200 is extended below the dancer rod 54 before passing through the gap between the driving shaft 51 and the rolling shaft 52, as shown in FIG. 6, so as to prevent overtension of the film wearing bag material 200 during delivering. As shown in FIG. 3, a braking means 55, having a spring element 551 extending upwardly, is affixed on a predetermined position of the second side wall 32 for pressing on one of the spool wheels 432 of the sleeving mounting spool assembly 43 for braking the roll of film wearing bag material 200 from rewinding.

The wearing platform 36, which is screwed onto the rear wall 35 and the front supporting frame 41 for covering the wearing bag delivery device 50, has three rectangular top opening 361, 362, 363 adapted for enabling a top portion of each rubber roller 512, 513, 514 exposed therethrough respectively. The wearing platform 36 further has a lateral sleeving standard mark 364 provided thereon.

Referring to FIGS. 3 and 4, the sleeving guide 46 is installed on a side of the wearing platform 36, adjacent to the film delivery guiding assembly 60, for spreading an opened side 202 of the film wearing bag material 200. The sleeving guide 46 has a raise front flat portion 461, and a rear inclined portion 462 inclinedly and upwardly extended from the wearing platform 36 to a back end of the raise front flat portion 461. As shown in FIGS. 3 and 6, when the film wearing bag material 200 is delivered onto the wearing platform 36, a wider upper layer 203 of the opened side 202 of the film wearing bag material 200 (as shown in FIG. 14) is guided to climb up the raise front flat portion 461 via the rear inclined portion 462 of the sleeving guide 46. In the means while, a lower layer 204 of the film wearing bag material 200 (as shown in FIG. 14) is extended on the flat wearing platform 36, so that the opened side 202 of the film wearing bag material 200 is spread by the sleeving guide 46 in order to facilitate the insertion of film into the film wearing sleeves 201.

Figure 8:
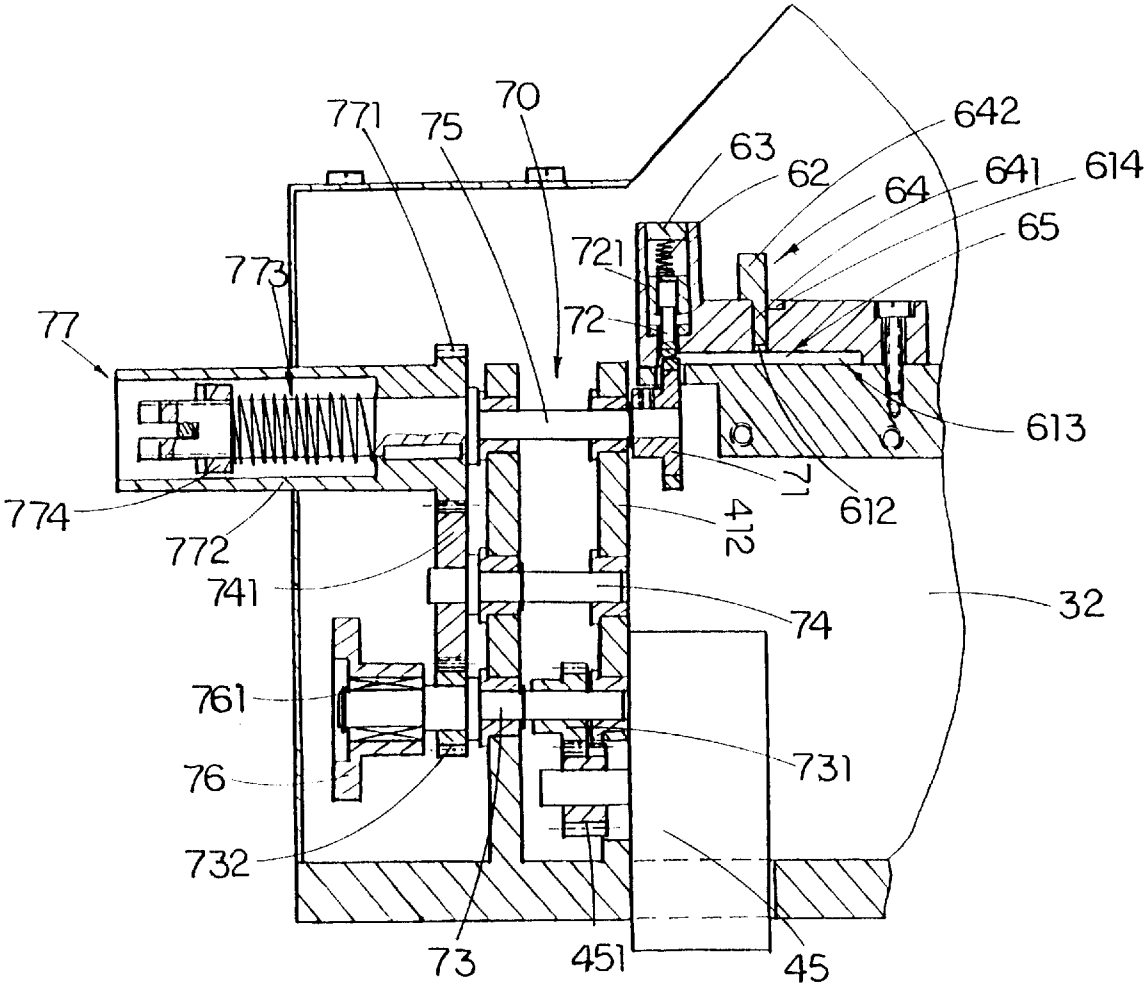
FIG. 8 is a sectional plan view of the film feeding device according to the above preferred embodiment of the present invention.
Figure 9:
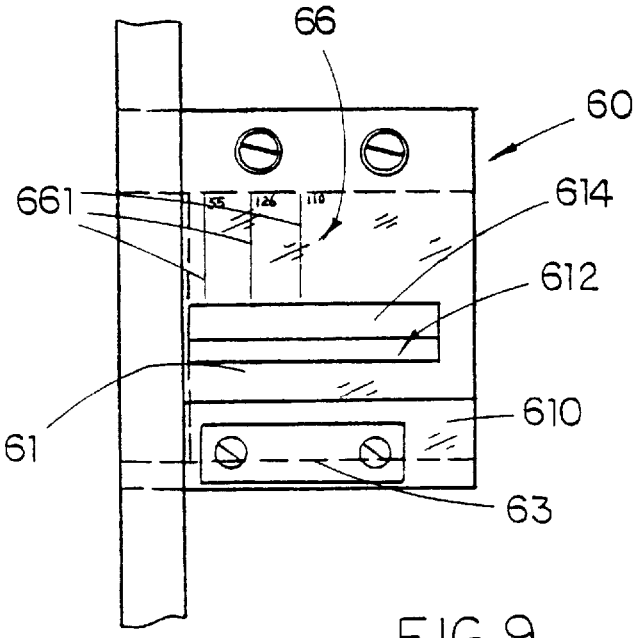
FIG. 9 is a plan view of the film delivery guiding assembly of the above preferred embodiment of the present invention.
Figure 10:
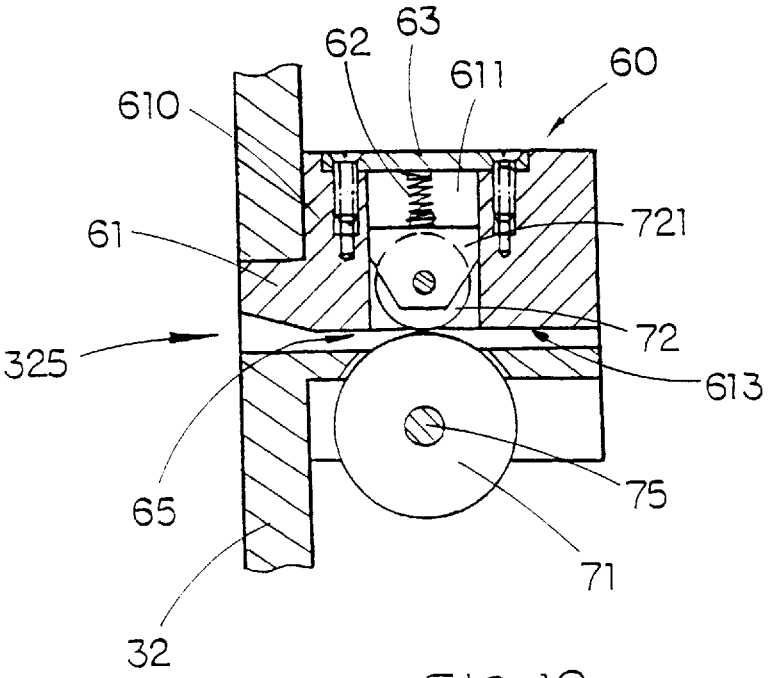
FIG. 10 is a sectional front view of the film delivery guiding assembly of the above preferred embodiment of the present invention.
Figure 11:
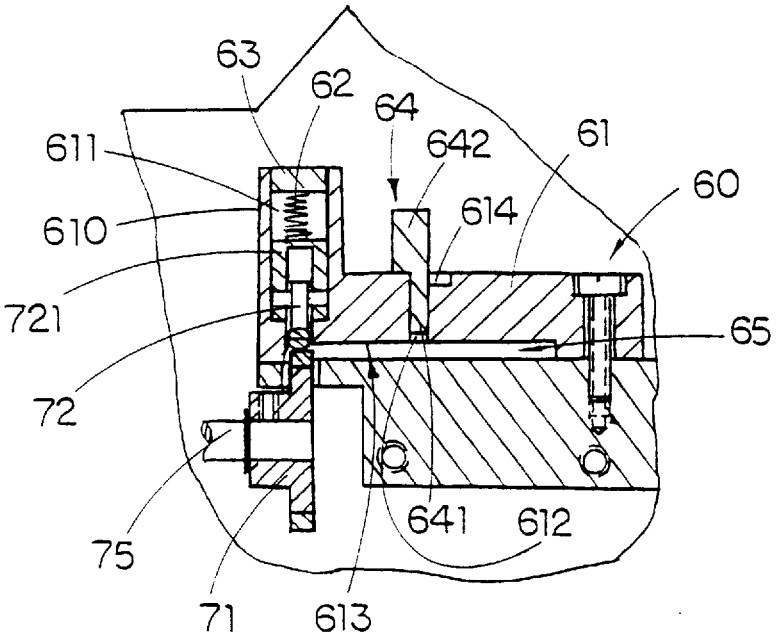
FIG. 11 is a sectional end view of the film delivery guiding assembly of the above preferred embodiment of the present invention.

Referring to FIGS. 4 and 8, the film feeding device 70 comprises a film driving wheel 71 pivotally mounted on the second end 412 of the front supporting frame 41, and a pressure wheel 72 rotatably mounted on the film delivery guiding assembly 60 and positioned above the film driving wheel 71, wherein the pressure wheel 72 is propped against the film driving wheel 71 (as shown in FIGS. 10 and 11).

The film feeding device 70 further comprises a driven axle 73, a transmission axle 74 and a driving axle 75 transversely and rotatably mounted on the second end 412 of the front supporting frame 41 respectively. The driven axle 73 has a rear end concentrically affixed with a film driven gear 731. The film driven gear 74 is engaged with an output gear 451 of the second stepper motor 45 which is mounted on the second end 412 of the front supporting frame 41. The driven axle 73 also has a front end concentrically affixed with a film first transmission gear 732 and a sleeve cutter driving wheel 76 which has a third one-way clutch means 761 installed therein to idle the sleeve cutter driving wheel 76 in clockwise rotation. Therefore, by means of the third one-way clutch means 761, when the driven axle 73 is driven by the second stepper motor 45 to rotate in anti-clockwise direction, the sleeve cutter driving wheel 76 is driven by the driven axle 73 to rotate anti-clockwise simultaneously. However, when the driven axle 73 is driven to rotate in clockwise direction, the sleeve cutter driving wheel 76 will remain idle.

The transmission axle 74 has a front end concentrically connected with a film second transmission gear 741 which is engaged with the film first transmission gear 732. The film driving wheel 71 is concentrically connected to a rear end of the driving axle 75. A film adjusting clutch assembly 77, which is concentrically connected with a front end of the driving axle 75, comprises a clutch driving gear 771 which is provided at a rear end of a cylindrical clutch sleeve 772 of the film adjusting clutch assembly 77, wherein the clutch driving gear 771 is engaged with the film second transmission gear 741 so as to drive the clutch sleeve 772 to rotate simultaneously. The film adjusting clutch assembly 77 further comprises a clutch spring 773 encased in the clutch sleeve 772 and slipped on the front end of the driving axle 75. The clutch spring 773 is compressed by a stopper 774 affixed to a frontmost end of the driving axle 75 for pressing the clutch driving gear 771 of the clutch sleeve 772 rearwards to ensure the engagement between the clutch driving gear 771 and the film second transmission gear 741. Therefore, to pull the clutch sleeve 772 frontwards will pull the clutch driving gear 771 frontwards simultaneously to disengage with the film second transmission gear 741. Thus, the user can manually operate the film driving wheel 71 to rotate easily by hand turning the clutch sleeve 772.

Figure 12:
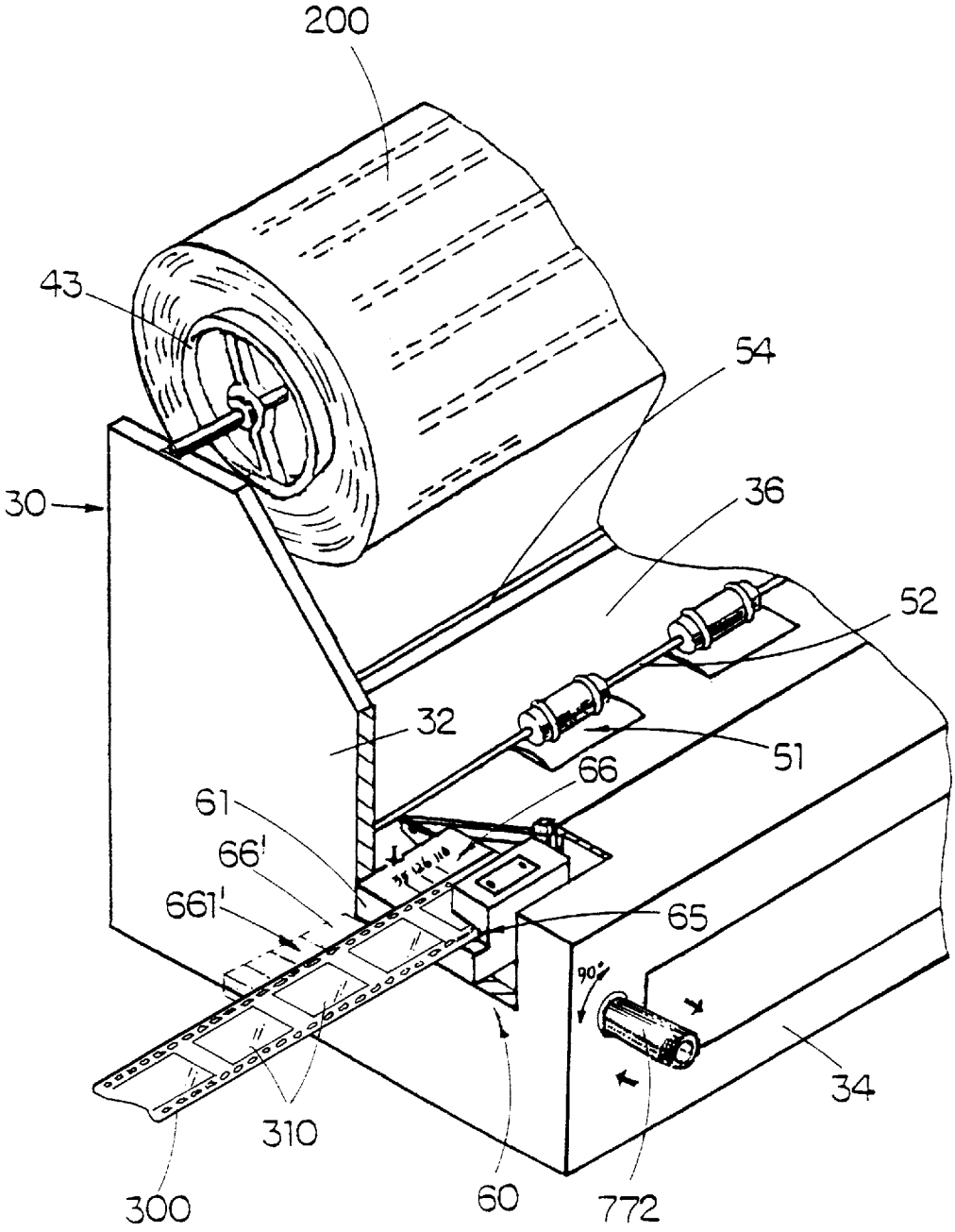
FIG. 12 is a partial section perspective view of the above preferred embodiment of the present invention, illustrating the feeding of the film through a feeding slot of the film delivery guiding assembly.

As shown in FIGS. 4 and 9 to 12, the film delivery guiding assembly 60 is installed on the housing 30 for guiding a roll of film 300, as shown in FIGS. 3 and 12, which has a predetermined number of continuous film units 310, to be delivered to the wearing platform 36 of the housing 30. The film delivery guiding assembly 60 is secured on a side support 322 which is affixed horizontally to an inner surface of the second side wall 32 at a predetermined height. A front end of the side support 322 has a lateral wheel slot 323 for enabling the film driving wheel 71 to upwardly pass therethrough. The film delivery guiding assembly 60 comprises a guiding seat 61, a pressing spring 62, a spring cover 63, and a guilder 64. The guiding seat 61 is made of transparent material by molding and has a protruding side wall 610 laterally provided at a front side thereof, a rectangular side hole 611 vertically passing through the protruding side wall 610, a guilder slot 612 transversely provided on a central portion of the guiding seat 61, and a transverse bottom groove 613 indented on a bottom surface of the guiding seat 61. The width of the bottom groove 613 should be equal to the width of the 35 mm film. A standard film marker 66 having three parallel mark lines 661 are provided, transversely of the feeding direction of the film 300, on a transparent top surface of the transparent guiding seat 61. The three mark lines 661 represent the length of the film unit of the 35 mm film, No. 110 film or 126 mm film respectively. Therefore the alignment of an interval edge 330 of the film 300 can be processed by simply matching with the respective mark line 661 of the standard film marker 66.

Since the guiding seat 61 is secured on the side support 322, the bottom groove 613 is incorporated with a flat top surface of the side support 322 to define a film entrance slot 65, as shown in FIG. 10. Also, the second side wall 32 of the housing 30 further has a rectangular film entrance opening 325 formed in a position matching with the film entrance slot 65, as shown in FIGS. 4 and 10, so that the film 300 can be fed into the film sleever machine of the present invention through the film entrance opening 324 and the film entrance slot 65 to the film feeding device 70 (as shown in FIG. 12). Since the guiding seat 61 is made of transparent meterial, the film units 310 feeding through the guiding seat 61 can be observed from outside.

As shown in FIGS. 4 and 11, a top portion of the guilder slot 612 rearwardly enlarges its width to form a step shoulder 614. The guilder 64 has a narrowed shank 641 and an enlarged head 642 so as to define a flat side surface and a step side surface, wherein the thickness and the height of the shank 641 is equal to the width and the depth of the guilder slot 612 respectively, and that the thickness of the head 642 is equal to the width of the step side shoulder 614. As shown in FIG. 11, when the shank 641 of the guilder 64 is inserted into the guilder slot 612 with the step surface of the guilder 64 facing frontwards, the shank 641 is totally hidden within the guilder slot 612, so that the film entrance slot 65 is adapted to match the 35 mm film. In order to match the narrower No.110 film, the user can simply pull out the guilder 64 and turn the guilder 64 in reverse direction for 180 degree and re-insert the guilder 64 into the guilder slot 612 with the step side surface of the guilder facing rearwards. In this situation, the step shoulder 614 may receive a bottom portion of the head 642 of the guilder 64. Therefore, a bottom end of the shank 641 of the guilder 64 may downwardly extend out of the guilder slot 612 to narrow the width of the film entrance slot 65 for adapting to the narrow width (16 mm) of the No. 110 film.

As shown in FIGS. 10 and 11, the pressure wheel 72 is pivotally mounted on a wheel holder 721. The wheel holder 721 is placed inside the side hole 611 of the guiding seat 61 until the pressure wheel 72 is abutted against the film driving wheel 71. The spring cover 63 is secured on the protruding side wall 610 to cover the side hole 611. The pressing spring 62 is positioned between the spring cover 63 and the wheel holder 721 so as to provide a downward pressure to the wheel holder 721 for propping the pressure wheel 72 against the film driving wheel 71.

Figure 13:
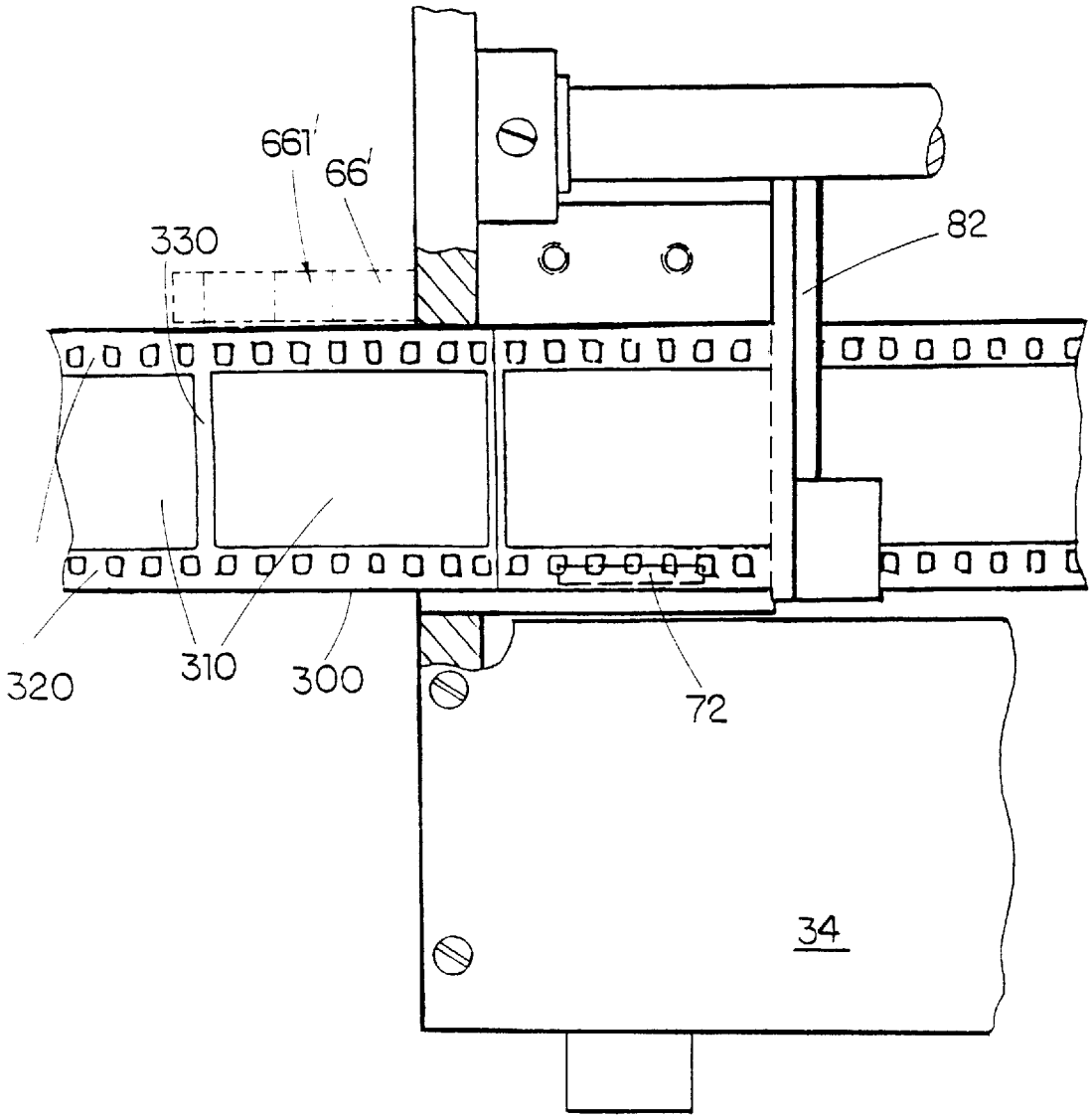
FIG. 13 is a partial sectional plan view of the above preferred embodiment of the present invention, illustrating the relationship between the pressure wheel, the film cutter and the film.

As shown in FIGS. 10 to 13, the film 300 is fed into the film sleever machine through the film entrance slot 65 (as shown in FIGS. 10 and 13). The film entrance slot 65 guides the film 300 to feed in straight, steadily and accurately. Within the film entrance slot 65, as shown in FIGS. 11 and 13, a feeding edge 320 of the film 300 passes through the gap between the film driving wheel 71 and the pressure wheel 72. Since the pressure wheel 72 presses the feeding edge 320 of the film 300 on the film driving wheel 71, the rotating driving wheel 71 will drive the film 300 to continuously feed in the film sleever machine. In other words, the feeding of the film 300 will not leave any tracks on the film units 310 since the neither the film driving wheel 71 nor the pressure wheel 72 will touch the surface of the film units 310.

Referring to FIGS. 4 and 6, the film cutter device 80 is mounted on the housing 30 for cutting off the film units 310 which are worn within the corresponding film wearing sleeve 201 on the wearing platform 36 from the roll of film 300. The film cutter device 80 comprises a bottom stationary blade 81 rigidly secured to a side edge of the side support 322 and positioned transversely of the feeding direction of the film 300, and a top cutting blade 82 pivotally connected with the bottom stationary blade 81 by a pin 811 in form of scissors. A blade handle 821 is extended downwardly and rearwardly from a rear end of the cutting blade 82. The blade handle 821 is connected with one end of a first elastic element 83 which another end is connected to a cutter supporting frame 84 attached to the second side wall 32, so that the cutting blade 82 is pulled upwards and remains in its upper position. As shown in FIGS. 4 to 6, the film cutter device 80 further comprises a cutter driving gear 85 and a cutter driving rod 86. The cutter driving gear 85 is rotatably mounted on the shaft support 422 of the rear supporting frame 42 and is engaged with the second transmission gear 533. One end of the cutter driving rod 86 is pivotally and eccentrically mounted on the cutting driving gear 85. Another end of the cutter driving rod 86 is pivotally connected to the blade handle 821. The film cutter device 80 further comprises a contact switch 87 affixed on the cutter supporting frame 84 and just adjacent to the blade handle 821 of the cutting blade 82, so that when the cutting blade 82 is in its upper position, the blade handle 821 keeps in contact with the contact switch 87. However, when the cutting blade 82 is driven to move downward to its lower position, the blade handle 821 moves upwardly away from the contact switch 87.

Therefore, when the first transmission gear 531, the transmission shaft 53 and the second transmission gear 532 are driven by the first stepper motor 44 to rotate forwardly, the cutter driving gear 85 is driven by the second transmission gear 532 to rotate rearwardly and drives the cutting blade 82, via the cutter driving rod 86 and the blade handle 821, to move toward the stationary blade 81 for scissoring the film 300 feeding therebetween from the film feeding device 70. As mentioned before, when the transmission shaft 53 is driven to rotate rearwardly, the transmission shaft 53 will rotate idly and the second transmission gear 533 will remain stationary by means of the second one-way clutch means 534 installed therein, so that the cutter driving gear 85 will also remain stationary. During this moment, the cutting blade 82 remains stationary as well.

In accordance with the above disclosed arrangement, the first stepper motor 44 acts as a power source of both the wearing bag delivery device 50 and the film cutter device 80. When the first stepper motor 44 drives its output gear 441 to rotate forwardly, it drives the driving shaft 51 to rotate forwardly to feed in a single unit of the film wearing sleeve 201 of the film wearing bag material 200. Besides, when the first stepper motor 44 drives its output gear 441 to rotate rearwardly, it drives the cutter driving gear 85 to rotate rearwardly to drive the cutting blade 82 to move downwardly towards the stationary blade 81 to cut the film 300.

Figure 7:
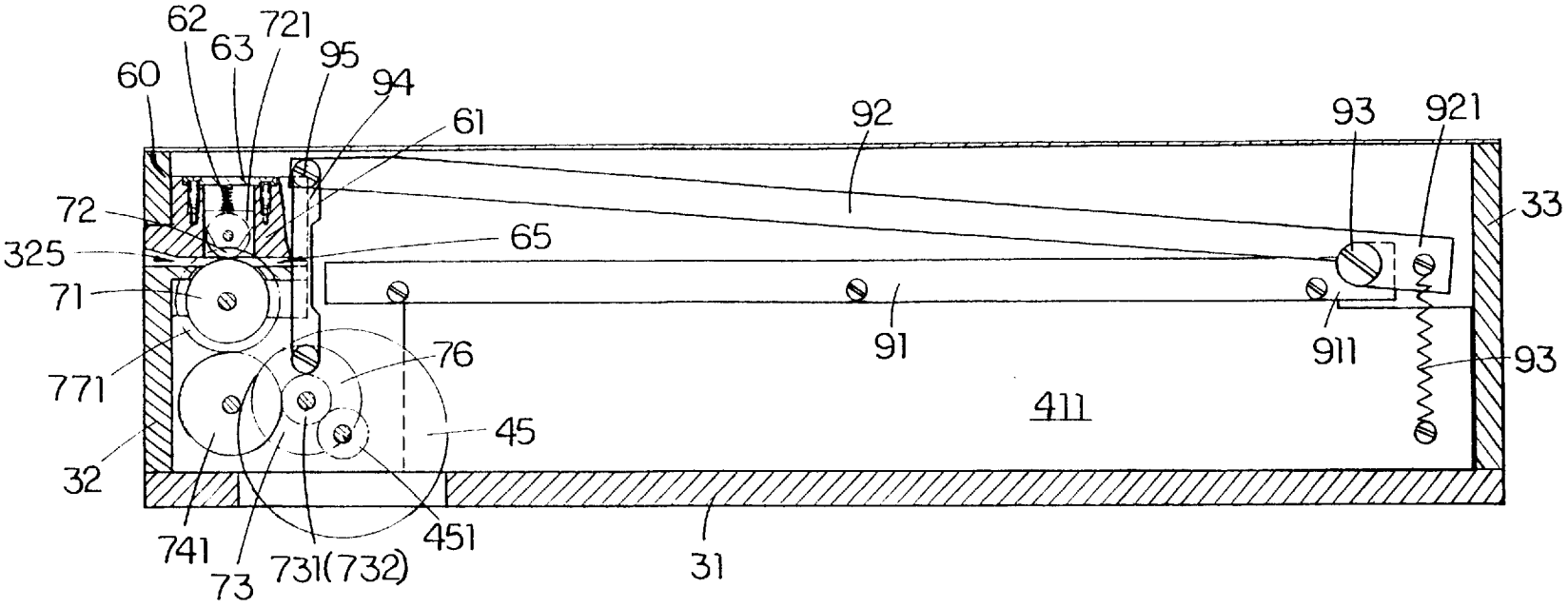
FIG. 7 is a partial front view of the above preferred embodiment, illustrating a film delivery guiding assembly and the constructive relationship between a film feeding device and a sleeve cutter device.

As shown in FIGS. 4 and 7, the sleeve cutter device 90 is mounted transversely on the front supporting frame 411 in the housing 30 for cutting off a predetermined number of film wearing sleeves 201 which worn with film units 310 therein from the roll of film wearing bag material 200. The sleeve cutter device 90 comprises a bottom cutter blade 91 and a top cutter blade 92. The bottom cutter blade 91 is rigidly secured to a top edge of the front supporting frame 411. A first end 921 of the top cutter blade 92 is pivotally connected with a first end 911 of the bottom cutter blade 91 by a pin 93 in form of scissors. The first end 921 of the top cutter blade 92 is connected with one end of a second elastic element 93 which another end is connected to the front supporting frame 411. As shown in FIGS. 4 and 8, the sleeve cutter device 90 further comprises the sleeve cutter driving wheel 76 and a crank 94 which one end is pivotally and eccentrically connected to the sleeve cutter driving wheel 76 while the other end of the crank 94 is pivotally and eccentrically connected to a second end 922 of the top cutter blade 92.

Therefore, when the driven axle 73 is driven by the second stepper motor 45 to rotate in anti-clockwise direction, the sleeve cutter driving wheel 76 is driven by the driven axle 73 to rotate anti-clockwise simultaneously and drives the top cutter blade 92 to move downwardly towards the bottom cutter blade 91 for scissoring the film wearing bag material 200 feeding therebetween from the wearing bag delivery device 50. However, when the driven axle 73 is driven by the second stepper motor 45 to rotate in clockwise direction, the sleeve cutter driving wheel 76 will remain idle and the top cutter blade 92 will also remain stationary. Accordingly, the second stepper motor 45 acts as a power source of both the film feeding device 70 and the sleeve cutter device 90.

The film sleever machine of the present invention further comprises an electrical controlling system S1, as shown in FIGS. 3 and 4, attached to the housing 30 for electrically controlling the activation timing, the rotation direction and the rotation angle of first and second stepper motors 44, 45 respectively.

Before operation, the controlling system S1 must be preset according to the kinds of film, such as 35 mm film, No. 110 film and 126 mm film. Since the number of units being sleeved in each film wearing sleeve 201 is determined by the rotation angle of the first and second stepper motors 44, 45 and the gear number of all the gears equipped in the film sleever machine of the present invention. For example, set the second stepper motor 45 to rotate one revolution for feeding in one unit of 35 mm film which has a length of 35 mm, to rotate 298.42 degree for feeding in one unit of No. 110 film which has a length of 110 mm, and to rotate 241.57 degree for feeding in one unit of 126 mm film which has a length of 126 mm.

In order to further disclose the features of the present invention, the operation process of the film sleever machine of the present invention for sleeving the 35 mm film (for example, 6 film units sleeving in one film sleeve) is described as follows.

A. INITIAL SETTING

INITIAL SETTING OF THE FILM WEARING BAG MATERIAL: As shown in FIGS. 3 and 6, install the roll of film wearing bag material 200 to the sleeving mounting spool assembly 43. Deliver the film wearing bag material 200 below the dancer rod 54. Place the wider upper layer 203 of the opened side 202 of the film wearing bag material 200 on the raise front flat portion 461 of the sleeving guide 46 and place the lower layer 204 of the film wearing bag material 200 on the flat wearing platform 36. Pass the film wearing bag material 200 through the gap between the driving shaft 51 and the rolling shaft 52 to exit through the front delivery opening 341 of the front cover 34. Align any one of the interval space 205 between two film wearing sleeves 201 (as shown in FIG. 14) with the sleeving standard mark 364 provided on the wearing platform 36. This process should only be carried when the entire roll of film wearing bag material 200 is used up and a new roll should be installed.

INITIAL SETTING OF THE FILM: As shown in FIGS. 3, 4 and 8, pull the film adjusting clutch assembly 77 out until the clutch driving gear 771 disengages with the film second transmission gear 741. Turn the film adjusting clutch assembly 77 anti-clockwise or clockwise for 90 degree. Feed the roll of 35 mm film 300 into the film entrance slot 65 and pass the film 300 through the gap between the film driving wheel 71 and the pressure wheel 72 within the film entrance slot 65. Due to the three parallel mark lines 661 provided on the transparent top surface of the transparent guiding seat 61, the user can align the interval edge 330 (as shown in FIG. 13) between two film units 310 with the respective mark line 661 so as to position the frontmost interval edge 330 between the bottom stationary blade 81 and the top cutting blade 82.

As shown in FIGS. 12 and 13, for a guiding seat 61 made of non-transparent material, a standard film marker rule 66' (as shown in dotted-line) with three parallel mark lines 661' provided thereon is affixed to the outer surface of the second side wall 32 and adjacent to the film entrance opening 325. The three mark lines 661' also represent the length of the film unit of the 35 mm film, No. 110 film or 126 mm film respectively. Therefore the alignment of the interval edge 330 of the film 300 can be processed by simply matching with the respective mark line 661' of the standard film marker rule 66'.

Finally, pull the film adjusting clutch assembly 77 out again, turn it anti-clockwise or clockwise for 90 degree and then push it back to its original position.

B. AUTOMATIC FILM SLEEVING

The film sleeving process, including (1) the feeding of film, (2) the cutting of film, (3) the delivery of the film wearing bag material, (4) the cutting of the film wearing bag material, and (5) the removal of the residual film tail, is entirely automatically carried by the film sleever machine of the present invention.

(1) THE FEEDING OF FILM: As shown in FIGS. 4 and 7, when power on, firstly the second stepper motor 45 starts to rotate anti-clockwise for 6×360 degree. The output gear 451 of the second stepper motor 45 is driven to rotate anti-clockwise for 6×360 degree. The clutch driving gear 771 is driven to rotate clockwise for 6×360 degree. Therefore, the film driving wheel 71 and the pressure wheel 72 are driven to rotate clockwise for 6×360 degree and anti-clockwise for 6×360 degree respectively, so as to feed 6 film units 310 of the film 300 to move inwardly to insert into a sleeve 201 aligned with the film entrance slot 65 on the wearing platform 36.

(2) THE CUTTING OF FILM: As shown in FIGS. 4 to 6, the controlling system S1 stops the second stepper motor 45 and activates the first stepper motor 44 to rotate rearwardly for 720 degree. The driving shaft 51 and the first and second transmission gears 531, 533 are driven to rotate forwardly for 360 degree, so as to drive the cutter driving gear 85 to rotate rearwardly for 360 degree. Therefore, the top cutting blade 82 will be driven to move down and up for once time to scissor off the film 300 at its interval edge 330 which is just located between the bottom stationary blade 81 and the top cutting blade 82.

(3) THE DELIVERY OF THE FILM WEARING BAG MATERIAL: As shown in FIGS. 4 to 6, the controlling system S1 stops the first stepper motor 44. After the scissoring action of the cutting blade 82, the cutting blade 82 is pulled upwards again by the first elastic element 83. At this moment, the blade handle 821 swings downwards and re-contacts with the contact switch 87 to activate the first stepper motor 44 and its output gear 441 to rotate forwardly for 720 degree. The driving gear 532 and the first transmission gear 532 are driven to rotate rearwardly for 360 degree. The driving shaft 51 and the driven gear 511 are thus driven to rotate forwardly for 180 degree to feed the film wearing bag material 200 forwards for a distance equal to the width of one film wearing sleeve 201, wherein the rolling shaft 52 is driven by the driving shaft 51 to rotate rearwardly for 360 degree due to the friction therebetween.

After the delivery of the film wearing bag material, the controlling system S1 will stop the first stepper motor 44 and re-activates the second stepper motor 45 to repeat the above step (1) and step (2) to feed in another 6 film units 310 of the film 300 and to cut the film. In other words, the controlling system S1 will control the first and second stepper motors 44, 45 to carry the above steps (1), (2) and (3) repeatedly until the entire roll of film 300 is worn with the film wearing sleeve, i.e. the cutting blade 82 has scissored for 6 times.

(4) THE CUTTING OF THE FILM WEARING BAG MATERIAL AND (5) REMOVAL OF THE RESIDUAL FILM TAIL: As shown in FIGS. 4 and 7, when the controlling system S1 counts that the cutting blade 82 has been activated to scissor for 6 times, the controlling system S1 then activates the second stepper motor 45 and its output gear 451 to rotate clockwise for 360 degree. The film driven gear 731 is driven to rotate anti-clockwise for 360 degree. The sleeve cutter driving wheel 76 is also driven to rotate anti-clockwise for 360 degree so as to transmit the cutter blade 92 to move downwards to scissor off the film wearing bag material 200. At the same time, the film second transmission gear 741 is also driven to rotate clockwise for 180 degree. Thus, the clutch driving gear 771 and the film driving wheel 71 are driven to rotate anti-clockwise for 180 degree, and the pressure wheel 72 is driven by the film driving wheel 71 to rotate clockwise for 360 degree due to the friction therebetween, so as to remove the residual film tail.

In accordance with the present invention, the following features of can be achieved.

1. The film sleever machine can cut a roll of film to a plurality of film strips with predetermined length and pack the film with film wearing bags automatically.
2. The film sleever machine is also adapted to automatically guide the feeding of the film, deliver the roll of film wearing bags, insert the film into the respective film wearing bag, cut the film, cut the film wearing bags, and remove the residual film tail.
3. The film sleever machine is easy to operate and can pack the film rapidly and accurately without damaging the film and staining the film with fingerprints.
4. The driving shaft of the film wearing bag driving roller is rotatably mounted on a supporting frame so as to ensure the concentricity of the driving shaft and reduce the operating noise.
5. The feeding of the roll of film is assisted and guided by a pressure wheel which is adapted to roll along the longitudinal side edge of the film, so that no track will be left on the film surface.
6. The feeding of the film is guided by a film guilder which is adjustable to adapted for guiding the feeding of both the 16 mm No. 110 film and the 35 mm film.
7. The feeding stoke of the delivery of the film wearing bag material is self-controlled by two stepper motors which are the power source of the present invention. In other words, no conventional photo sensor blocking device is used, so that the film wearing bag material does not required to be printed with blocking color signs thereon. It greatly reduces the manufacturing cost of the film wearing bag material.

I claim:

1. A film sleever machine, comprising a housing having a top wearing platform and a front delivery opening provided thereon;

a front and a rear supporting frame affixed in said housing;

a sleeving mounting spool assembly having a mounting spool pivotally mounted on said housing for rotatably supporting a roll of film wearing bag material which has a predetermined number of film wearing sleeves transversely and continuously connected with each other;

a wearing bag delivery device which comprises a driving shaft pivotally mounted transversely on said rear supporting frame and a rolling shaft rotatably mounted in parallel and above said driving shaft;

a first stepper motor mounted in said housing for driving said driving shaft to rotate for a predetermined number of revolution, so that said driving shaft drives said film wearing bag material longitudinally feeding between said driving shaft and said rolling shaft and delivering on said wearing platform of said housing, wherein said first stepper motor is controlled by a controlling system to drive said driving shaft to feed forward one film wearing sleeve per each forward activation of said first stepper motor;

a sleeving guide installed on a side of said wearing platform for spreading an opened side of said film wearing bag material;

a film delivery guiding assembly, which is installed on said housing and adjacent to said sleeving guide, for guiding a roll of film, which has a plurality of continuous film units, to be delivered to said wearing platform of said housing;

a film feeding device comprising a film driving wheel and a pressure wheel, wherein said film driving wheel is pivotally mounted on a lateral side of said front supporting frame, said pressure wheel, which is rotatably mounted on said film delivery guiding assembly, being positioned above and propped against said film driving wheel;

a second stepper motor mounted on said front supporting frame for driving said film driving wheel to rotate for a predetermined number of revolution, so that, per each forward activation of said second stepper motor, said film driving wheel drives a predetermined number of film units of said roll of film to feed between said film driving wheel and said pressure wheel for inserting into one of said film wearing sleeves of said film wearing bag material, positioning on said wearing platform, through said spread opened side thereof, wherein said second stepper motor is also controlled by said controlling system to drive said film driving wheel to feed forward a predetermined number of film units per each forward activation of said second stepper motor;

a film cutter device mounted on said housing for cutting off said predetermined number of film units from said roll of film after said predetermined number of film units are worn within said corresponding film wearing sleeve positioned on said wearing platform; and a sleeve cutter device mounted transversely on said front supporting frame in said housing for cutting off a predetermined number of film wearing sleeves from said roll of film wearing bag material after said predetermined number of film wearing sleeves are worn with said film units of said roll of film therein.

2. A film sleever machine, as recited in claim 1, in which said film cutter device is activated by said first stepper motor and said sleeve cutter device is activated by said second stepper motor.

3. A film sleever machine, as recited in claim 2, in which said housing has a first side wall and a second side wall, said sleeving mounting spool assembly comprising a mounting spool and two spool wheels detachably affixed to two end portions of said mounting spool, said sleeving mounting spool assembly being pivotally mounted on said housing by pivotally sitting two end axles of said mounting spool between two upwardly extending side supporters of said first and second side walls respectively, for rotatably supporting said roll of film wearing bag material.

4. A film sleever machine, as recited in claim 3, in which said wearing bag delivery device comprises a driving shaft and a rolling shaft rotatably mounted in parallel and above said driving shaft, said rear supporting frame comprising two parallel shaft supports, wherein said driving shaft is transversely and pivotally mounted between said two shaft supports, said driving shaft having a first end extending through said first shaft support to integrally and concentrically connect with a driven gear which has a first one-way clutch means installed therein to idle said driven gear during reverse rotation.

5. A film sleever machine, as recited in claim 4, in which said driving shaft has at least two rubber rollers concentrically and spacedly mounted thereon for facilitating said delivery of said film wearing bag material.

6. A film sleever machine, as recited in claim 4, in which said wearing bag delivery device further comprises a transmission shaft, which is positioned below said driving shaft and is pivotally mounted between said first and second shaft supports of said rear supporting frame, said transmission shaft having a first end and a second end extending through said first shaft support and said second shaft support respectively, wherein said first end of said transmission shaft is concentrically connected with a first transmission gear and a driving gear, said first transmission gear being engaged with said driven gear of said driving shaft and said driving gear being engaged with an output gear of said first stepper motor, said second end of said transmission shaft being concentrically connected with a second transmission gear which has a second one-way clutch means installed therein to idle said second transmission gear during reverse rotation.

7. A film sleever machine, as recited in claim 6, in which an inner side of each said side wall provides a pivot seat for rotatably mounting said rolling shaft between said two side walls and parallelly positioning just above said driving shaft.

8. A film sleever machine, as recited in claim 7, in which said rolling shaft has at least two O-ring spacers concentrically mounted thereon and aligned with said rubber rollers.

9. A film sleever machine, as recited in claim 7, in which each said pivot seat has a spring means adapted for pressing said rolling shaft downwards so as to prop said O-ring spacers against said rubber rollers.

10. A film sleever machine, as recited in claim 9, in which said inner side of each said side wall further has a L-shape groove provided thereon for rotatably mounting a dancer rod therebetween.

11. A film sleever machine, as recited in claim 3, further comprising a braking means, which has a spring element extending upwardly, is affixed on a predetermined position of one of said side wall for pressing on one of said spool wheels of said sleeving mounting spool assembly for braking said roll of film wearing bag material from rewinding.

12. A film sleever machine, as recited in claim 7, in which said wearing platform has at least two top opening adapted for enabling a top portion of each said rubber roller exposed therethrough respectively.

13. A film sleever machine, as recited in claim 7, in which said wearing platform has a lateral sleeving standard mark provided thereon.

14. A film sleever machine, as recited in claim 1, in which said sleeving guide is installed on a side of said wearing platform, adjacent to said film delivery guiding assembly, for spreading said opened side of said film wearing bag material, said sleeving guide having a raise front flat portion and a rear inclined portion inclinedly and upwardly extended from said wearing platform to a back end of said raise front flat portion.

15. A film sleever machine, as recited in claim 7, in which said sleeving guide is installed on a side of said wearing platform, adjacent to said film delivery guiding assembly, for spreading said opened side of said film wearing bag material, said sleeving guide having a raise front flat portion and a rear inclined portion inclinedly and upwardly extended from said wearing platform to a back end of said raise front flat portion.

16. A film sleever machine, as recited in claim 7, in which said film feeding device comprises a film driving wheel pivotally mounted on said second end of said front supporting frame, and a pressure wheel rotatably mounted on said film delivery guiding assembly and positioned above said film driving wheel, wherein said pressure wheel is propped against said film driving wheel.

17. A film sleever machine, as recited in claim 16, in which said film feeding device further comprises a driven axle, a transmission axle and a driving axle transversely and rotatably mounted on a second end of said front supporting frame respectively, said driven axle having a rear end concentrically affixed with a film driven gear, said film driven gear being engaged with an output gear of said second stepper motor which is mounted on said second end of said front supporting frame, said driven axle having a front end concentrically affixed with a film first transmission gear and a sleeve cutter driving wheel which has a third one-way clutch means installed therein to idle said sleeve cutter driving wheel during clockwise rotation, said transmission axle having a front end concentrically connected with a film second transmission gear which is engaged with said film first transmission gear, said film driving wheel being concentrically connected to a rear end of said driving axle, said film feeding device further comprising a film adjusting clutch assembly, which is concentrically connected with a front end of said driving axle, including a clutch driving gear which is provided at a rear end of a cylindrical clutch sleeve of said film adjusting clutch assembly, wherein said clutch driving gear is engaged with said film second transmission gear so as to drive said clutch sleeve to rotate simultaneously.

18. A film sleever machine, as recited in claim 17, in which said film adjusting clutch assembly further comprises a clutch spring encased in said clutch sleeve and slipped on said front end of said driving axle, said clutch spring being compressed by a stopper which is affixed to a frontmost end of said driving axle for pressing said clutch driving gear of said clutch sleeve rearwards to ensure said engagement between said clutch driving gear and said film second transmission gear.

19. A film sleever machine, as recited in claim 3, in which said film delivery guiding assembly is secured on a side support which is affixed horizontally to an inner surface of said second side wall at a predetermined height, a front end of said side support having a lateral wheel slot for enabling said film driving wheel to upwardly pass therethrough, said film delivery guiding assembly further comprising a guiding seat, a pressing spring, and a spring cover, wherein said guiding seat has a protruding side wall laterally provided at a front side thereof, a side hole vertically passing through said protruding side wall, and a transverse bottom groove indented on a bottom surface of said guiding seat, in which said bottom groove is incorporated with a flat top surface of said side support to define a film entrance slot, also, said second side wall of said housing further having a film entrance opening formed in a position matching with said film entrance slot.

20. A film sleever machine, as recited in claim 19, in which said film delivery guiding assembly further comprises a guilder and said guiding seat has a guilder slot transversely provided thereon, wherein a top portion of said guilder slot rearwardly enlarges its width to form a step shoulder, said guilder having a narrowed shank and an enlarged head so as to define a flat side surface and a step side surface, wherein a thickness and a height of said shank is equal to a width and a depth of said guilder slot respectively, and that a thickness of said head is equal to a width of said step side shoulder, therefore when said shank of said guilder is inserted into said guilder slot with said step surface of said guilder facing frontwards, said shank is totally hidden within said guilder slot, however when said guilder 64 is turned in reverse direction for 180 degree and re-inserted into said guilder slot with said step side surface of said guilder facing rearwards, and then said step shoulder receives a bottom portion of said head of said guilder and a bottom end of said shank of said guilder is downwardly extended out of said guilder slot to narrow said film entrance slot.

21. A film sleever machine, as recited in claim 18, in which said film delivery guiding assembly is secured on a side support which is affixed horizontally to an inner surface of said second side wall at a predetermined height, a front end of said side support having a lateral wheel slot for enabling said film driving wheel to upwardly pass therethrough, said film delivery guiding assembly further comprising a guiding seat, a pressing spring, and a spring cover, wherein said guiding seat has a protruding side wall laterally provided at a front side thereof, a side hole vertically passing through said protruding side wall, and a transverse bottom groove indented on a bottom surface of said guiding seat, in which said bottom groove is incorporated with a flat top surface of said side support to define a film entrance slot, also, said second side wall of said housing further having a film entrance opening formed in a position matching with said film entrance slot.

22. A film sleever machine, as recited in claim 21, in which said pressure wheel is pivotally mounted on a wheel holder which is placed inside said side hole of said guiding seat until said pressure wheel is abutted against said film driving wheel, said spring cover being secured on said protruding side wall to cover said side hole, said pressing spring being positioned between said spring cover and said wheel holder so as to provide a downward pressure to said wheel holder for propping said pressure wheel against said film driving wheel.

23. A film sleever machine, as recited in claim 22, in which said film delivery guiding assembly further comprises a guilder and said guiding seat has a guilder slot transversely provided thereon, wherein a top portion of said guilder slot rearwardly enlarges its width to form a step shoulder, said guilder having a narrowed shank and an enlarged head so as to define a flat side surface and a step side surface, wherein a thickness and a height of said shank is equal to a width and a depth of said guilder slot respectively, and that a thickness of said head is equal to a width of said step side shoulder, therefore when said shank of said guilder is inserted into said guilder slot with said step surface of said guilder facing frontwards, said shank is totally hidden within said guilder slot, however when said guilder 64 is turned in reverse direction for 180 degree and re-inserted into said guilder slot with said step side surface of said guilder facing rearwards, and then said step shoulder receives a bottom portion of said head of said guilder and a bottom end of said shank of said guilder is downwardly extended out of said guilder slot to narrow said film entrance slot.

24. A film sleever machine, as recited in claim 7, in which said film cutter device comprises a bottom stationary blade rigidly secured to said housing and positioned transversely of the feeding direction of said film, and a top cutting blade pivotally connected with said bottom stationary blade by a pin in form of scissors, a blade handle being extended downwardly and rearwardly from a rear end of said cutting blade, said blade handle being connected with one end of a first elastic element which another end is connected to a cutter supporting frame attached to said second side wall, said film cutter device further comprising a cutter driving gear and a cutter driving rod, wherein said cutter driving gear is rotatably mounted on said second shaft support of said rear supporting frame and is engaged with said second transmission gear, one end of said cutter driving rod being pivotally and eccentrically mounted on said cutting driving gear, another end of said cutter driving rod being pivotally connected to said blade handle.

25. A film sleever machine, as recited in claim 24, in which aid film cutter device further comprises a contact switch affixed on said cutter supporting frame and just adjacent to said blade handle of said cutting blade, so that when said cutting blade is in an upper position, said blade handle keeps in contact with said contact switch. However, when said cutting blade 82 is driven to move downward to its lower position, said blade handle 821 moves upwardly away from said contact switch 87.

26. A film sleever machine, as recited in claim 22, in which said film cutter device comprises a bottom stationary blade rigidly secured to a side edge of said side support and positioned transversely of the feeding direction of said film, and a top cutting blade pivotally connected with said bottom stationary blade by a pin in form of scissors, a blade handle being extended downwardly and rearwardly from a rear end of said cutting blade, said blade handle being connected with one end of a first elastic element which another end is connected to a cutter supporting frame attached to said second side wall, said film cutter device further comprising a cutter driving gear and a cutter driving rod, wherein said cutter driving gear is rotatably mounted on said second shaft support of said rear supporting frame and is engaged with said second transmission gear, one end of said cutter driving rod being pivotally and eccentrically mounted on said cutting driving gear, another end of said cutter driving rod being pivotally connected to said blade handle.

27. A film sleever machine, as recited in claim 26, in which aid film cutter device further comprises a contact switch affixed on said cutter supporting frame and just adjacent to said blade handle of said cutting blade, so that when said cutting blade is in an upper position, said blade handle keeps in contact with said contact switch. However, when said cutting blade 82 is driven to move downward to its lower position, said blade handle 821 moves upwardly away from said contact switch 87.

28. A film sleever machine, as recited in claim 18, in which said sleeve cutter device comprises a bottom cutter blade and a top cutter blade, said bottom cutter blade being rigidly secured to a top edge of said front supporting frame, a first end of said top cutter blade being pivotally connected with a first end of said bottom cutter blade by a pin in form of scissors, said first end of said top cutter blade is connected with one end of a second elastic element which another end is connected to said front supporting frame, said sleeve cutter device further comprising and a crank which one end is pivotally and eccentrically connected to said sleeve cutter driving wheel while said other end of said crank is pivotally and eccentrically connected to a second end of said top cutter blade.

29. A film sleever machine, as recited in claim 26, in which said sleeve cutter device comprises a bottom cutter blade and a top cutter blade, said bottom cutter blade being rigidly secured to a top edge of said front supporting frame, a first end of said top cutter blade being pivotally connected with a first end of said bottom cutter blade by a pin in form of scissors, said first end of said top cutter blade is connected with one end of a second elastic element which another end is connected to said front supporting frame, said sleeve cutter device further comprising and a crank which one end is pivotally and eccentrically connected to said sleeve cutter driving wheel while said other end of said crank is pivotally and eccentrically connected to a second end of said top cutter blade.

30. A film sleever machine, as recited in claim 29, in which said housing further comprises a bottom board, a front cover which is detachably mounted on said two side walls, and a rear wall affixed on a rear side of said bottom board, wherein said two side walls are perpendicularly affixed on a right side and a left side of said bottom board respectively, said front delivery opening being formed at a front side of said front cover, said wearing platform covering said housing by securing onto said rear wall and said front supporting frame.

* * * * *